United States Patent [19]

Dittmar et al.

[11] Patent Number: 4,706,484

[45] Date of Patent: Nov. 17, 1987

[54] UNIVERSAL ROLLING MILL

[75] Inventors: Robert W. Dittmar; Winfried Schmiedberg, both of Pittsburgh, Pa.

[73] Assignee: United Engineering Rolling Mills, Inc., Pittsburgh, Pa.

[21] Appl. No.: 889,741

[22] Filed: Jul. 28, 1986

[51] Int. Cl.[4] ..... B21B 13/08; B21B 31/08

[52] U.S. Cl. ..... 72/225; 72/238; 72/239

[58] Field of Search ..... 72/225, 237, 238, 239

[56] References Cited

U.S. PATENT DOCUMENTS

| | | | |
|---|---|---|---|
| 3,098,404 | 7/1963 | Morath et al. | 72/225 |
| 3,248,919 | 5/1966 | Hewitt et al. | 72/238 |
| 3,566,498 | 3/1971 | Kato et al. | 72/239 X |
| 3,699,794 | 10/1972 | Buchheit | 72/225 |
| 3,802,242 | 4/1974 | Svagr | 72/225 |
| 3,866,454 | 2/1975 | Muller | 72/238 |
| 3,899,910 | 8/1975 | Aramaki | 72/239 |
| 3,949,586 | 4/1976 | Neumann | 72/238 |
| 4,399,680 | 8/1983 | Hartmann | 72/225 |

FOREIGN PATENT DOCUMENTS

| | | | |
|---|---|---|---|
| 2753977 | 6/1979 | Fed. Rep. of Germany | 72/225 |
| 0144501 | 8/1984 | Japan | 72/225 |

*Primary Examiner*—Robert L. Spruill
*Assistant Examiner*—Steve Katz
*Attorney, Agent, or Firm*—Arnold B. Silverman; Suzanne Kikel

[57] ABSTRACT

An internal frame carrying vertical rolls of a roll set permanently remains in the mill. The frame consists of spaced-apart cross members tied together on each end by a yoke member. Clamping plates hold the frame down in the mill. Pass line adjustment of the vertical rolls is done through vertical movement of the frame. The yoke on the operating side is removable and is raised and lowered for roll set changing, and is equipped at its top with tracks which in the removable yoke's lower position form part of a rail system in the roll set changing operation. Pins and cylinders hold the removable yoke to the cross members. Stooling pins are automatically engaged in the chocks of the vertical and horizontal rolls forming an interlocking roll set for its removal from the mill.

7 Claims, 7 Drawing Figures

UNIVERSAL ROLLING MILL

BACKGROUND OF THE INVENTION

This invention relates to a universal rolling mill having a set of both horizontal and vertical rolls for rolling structural sections, beams, rails, and other shaped products. More particularly, it relates to an internal frame construction mounted in the mill for carrying the vertical rolls and in which the horizontal rolls are mounted and which frame remains in the mill during roll set changing and is moved vertically with the vertical and horizontal rolls for pass line adjustment for varying size stock. A removable part of the frame and an automatic stooling pin arrangement interlocking the chocks for both the vertical and horizontal rolls facilitate roll set changing.

When rolling beams or similar shaped sections in a universal rolling mill, so-called lifting or tilting tables are usually employed to convey the stock traveling on the entry and delivery roller tables to and from the rolling mill. Lifting tables are essential because on the one hand, the level of the transporting surface of the approach table is otherwise fixed and, on the other hand, the height of the pass line will be determined and fixed in relation to the surface of the roller table by the largest shape to be rolled. When smaller sections are to be rolled in the mill, it is thus necessary to accommodate the difference in the height of the roller table surface and the pass line by means of lifting tables to ensure that the section enters and leaves the universal mill at the proper roll pass elevation.

Through the use of lifting tables, the shape to be rolled is advanced into the mill essentially at an angle to the pass line. This in many cases can create unacceptable product due to the undesirable stresses and deflection of the product during rolling.

To some extent this problem is exemplified in U.S. Pat. No. 3,968,672 issuing on July 13, 1976. These lifting tables are used with the stands where the vertical and horizontal rolls are fixed, i.e., the pass line cannot be varied due to the mounting of the vertical rolls in the mill.

An arrangement had been devised where a cassette frame carrying both horizontal and vertical rolls is supported on a traversable carriage in the vertical housing windows. This type of cassette frame construction allows for passline adjustment and is accomplished by providing shims, threaded spindles, wedges, or piston cylinder assemblies arranged between the frame and carriage. A mill with a cassette frame is exemplified in U.S. Pat. No. 3,559,440 issuing Feb. 2, 1971.

A serious limitation to this cassette type frame is that the frame is joined together and the roll set is an integral part of the cassette frame. When it is necessary to change the roll set, there is no easy way for the cassette frame to remain in the mill, and still gain access to the roll set. The cassette frame with its roll set must be removed from the mill and replaced by another cassette frame with its roll set. In order to replace the worn roll set, the cassette frame has to be conveyed to a working area for its disassemblage and reassemblage. This operation requires added expense represented in labor, time, and equipment. The overall effect of these immediately aforesaid economic factors reduces considerably the significance of the advantage realized from the use of the cassette frame of the present day designs.

The aforesaid drawbacks when using lifting tables for rolling beams and other shaped sections with universal mills are eliminated with the teachings of the present invention. A mill is thus provided which enables the oncoming and exiting stock to be conveyed from the approach and delay tables respectively relative to the mill passline without the need of a lifting table.

The aforesaid drawbacks when using the integral cassette frame which must be removed with the roll set are also eliminated with the teachings of the present invention. A mill is thus provided which supports a frame for carrying the roll set which frame remains in the mill and only a portion of the frame on the operating side of the mill is quickly made removeable so that the roll set can be removed in a roll set changing operation.

SUMMARY OF THE INVENTION

It is, therefore, an object of the present invention to provide a universal mill which in addition to being free from each and every one of the aforesaid limitations and deficiencies, has certain other significant advantages that make it substantially more economical to construct and operate than present-day universal mills.

It is a further object of the present invention to provide a frame which interconnects with the vertical housing of a universal type mill and is moved vertically along the housings for pass line adjustment. The frame consists of spaced-apart cross members tied together on one end by a fixed yoke and on the other end by a removable yoke. This removable yoke is retained in the cross members by pins and piston cylinder assemblies and is equipped at its upper portion with tracks, which when the removable yoke is lowered, form part of a rail system for the roll set changing operation. A lifting unit equipped with rails is provided in the mill which unit when raised activates a stooling pin arrangement in both the vertical and horizontal roll chocks thereby interlocking the roll set for its removal as a unit from the mill. Jacks located outside the mill abut the underside of the cross members for fast and accurate pass line adjustment.

A still broader object of the present invention is to provide a construction for an internal frame arranged in the mill to give the desired rigidity to the roll set, to give quick and accurate passline adjustment and the optimum simplicity in roll changing of all rolls as a unit in an arrangement where improved tolerance of the beam can be more realized.

BRIEF DESCRIPTION OF THE DRAWINGS

These objects, as well as other novel features and advantages of the present invention, will be better appreciated and understood when the following description thereof is read along with the accompanying drawings of which.

DETAILED DESCRIPTION OF A PREFERRED EMBODIMENT

Figure 1:
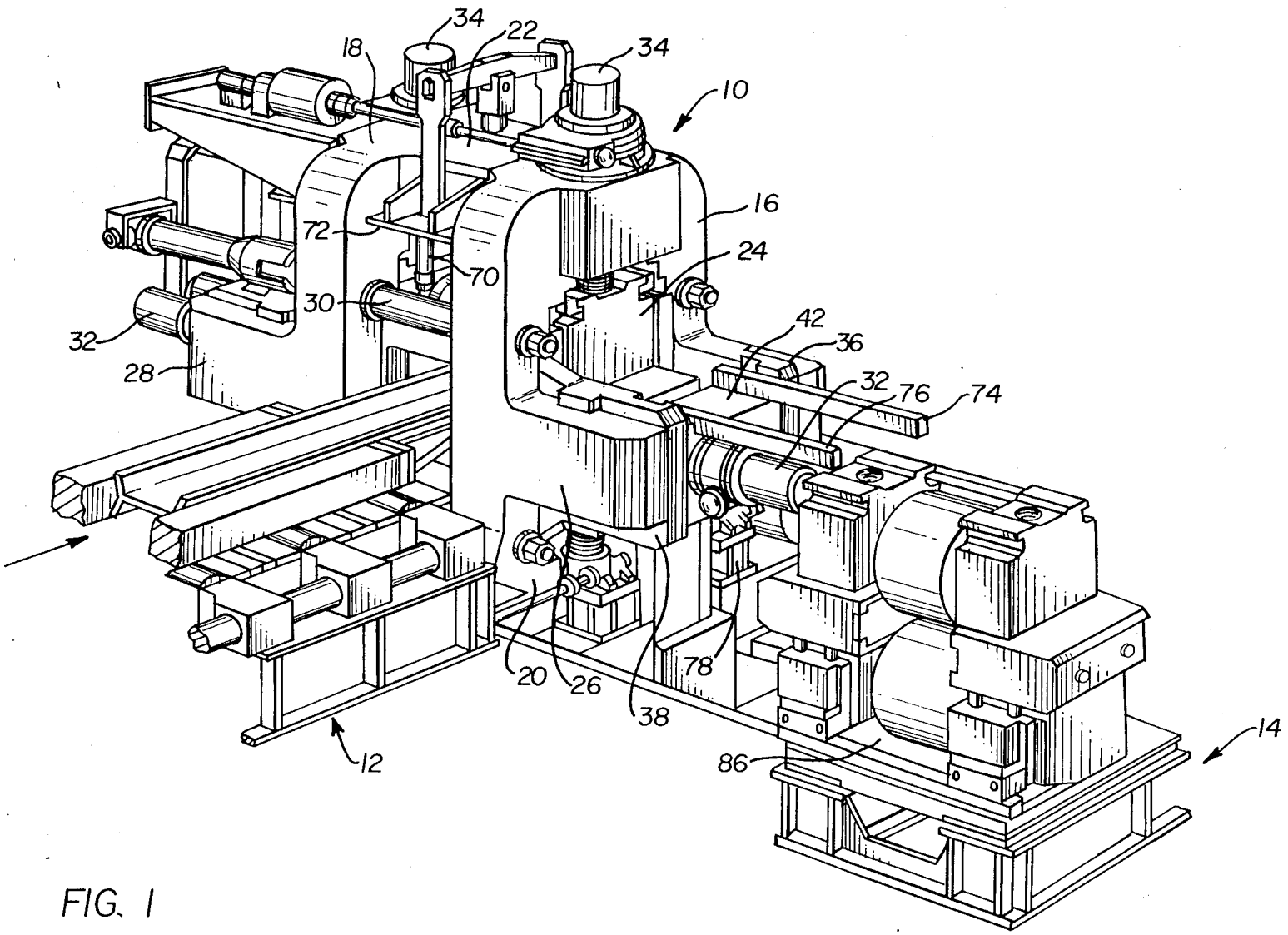
FIG. 1 is an isometric view illustrating a universal mill of the present invention.

With reference to FIG. 1 there is illustrated a universal mill 10 having a roll set consisting of both horizontal and vertical rolls for rolling a beam from stock which is supported on an approach roller table 12. When looking into FIG. 1 the left side of mill 10 is referred to as the drive side, and the right side is referred to as the operating side. The components of mill 10 are referenced in FIGS. 1–7 with the same number. The rolls are driven conventionally through the spindles and drives shown therein. A new roll set is positioned on a side shifting roll changing rig 14 adjacent to the mill 10 on the operating side for replacement of the worn roll set in the mill, more about which will be explained shortly.

In FIGS. 1–6, mill 10 comprises a pair of vertically arranged spaced-apart mill housings 16 and 18 rigidly secured at their lower ends to bed plates 20, and connected together at their upper and and lower ends by horizontally disposed tie bolts 30 and separators, one of which is shown at 22 in FIG. 1. The housings in 16, 18 are provided with elongated windows which receive an inner frame 24. As FIG. 1 shows, housings 16, 18 each have a horizontally disposed wing 26, 28, for supporting inner frame 24. In a conventional manner tie bolts 30 (best shown in FIG. 2) extend between vertical housings 16, 18.

Figure 4:
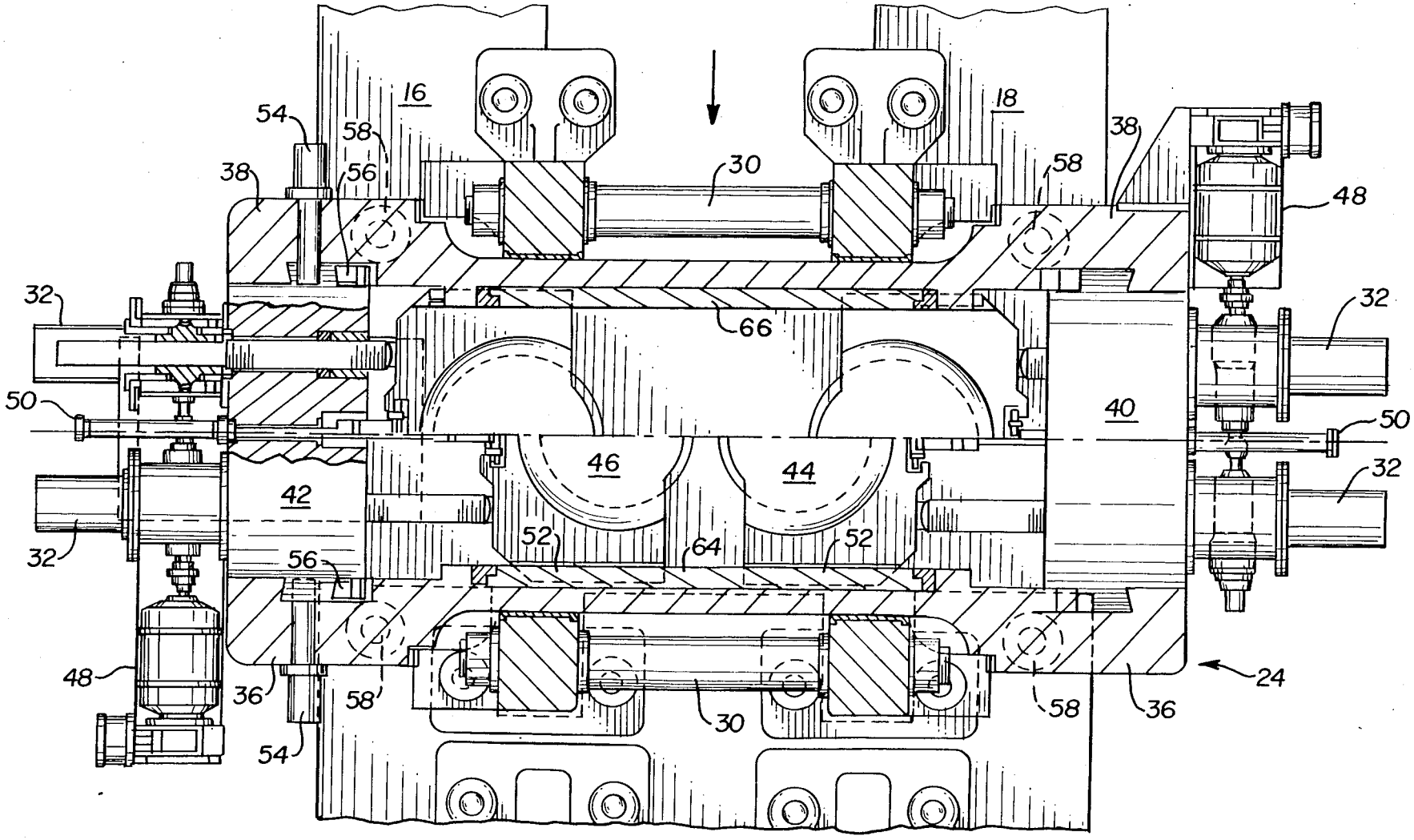
FIG. 4 is a sectional, elevational view taken along lines 4—4 of FIG. 3 wherein the vertical rolls are shown in their maximum and minimum operating positions.
Figure 5:
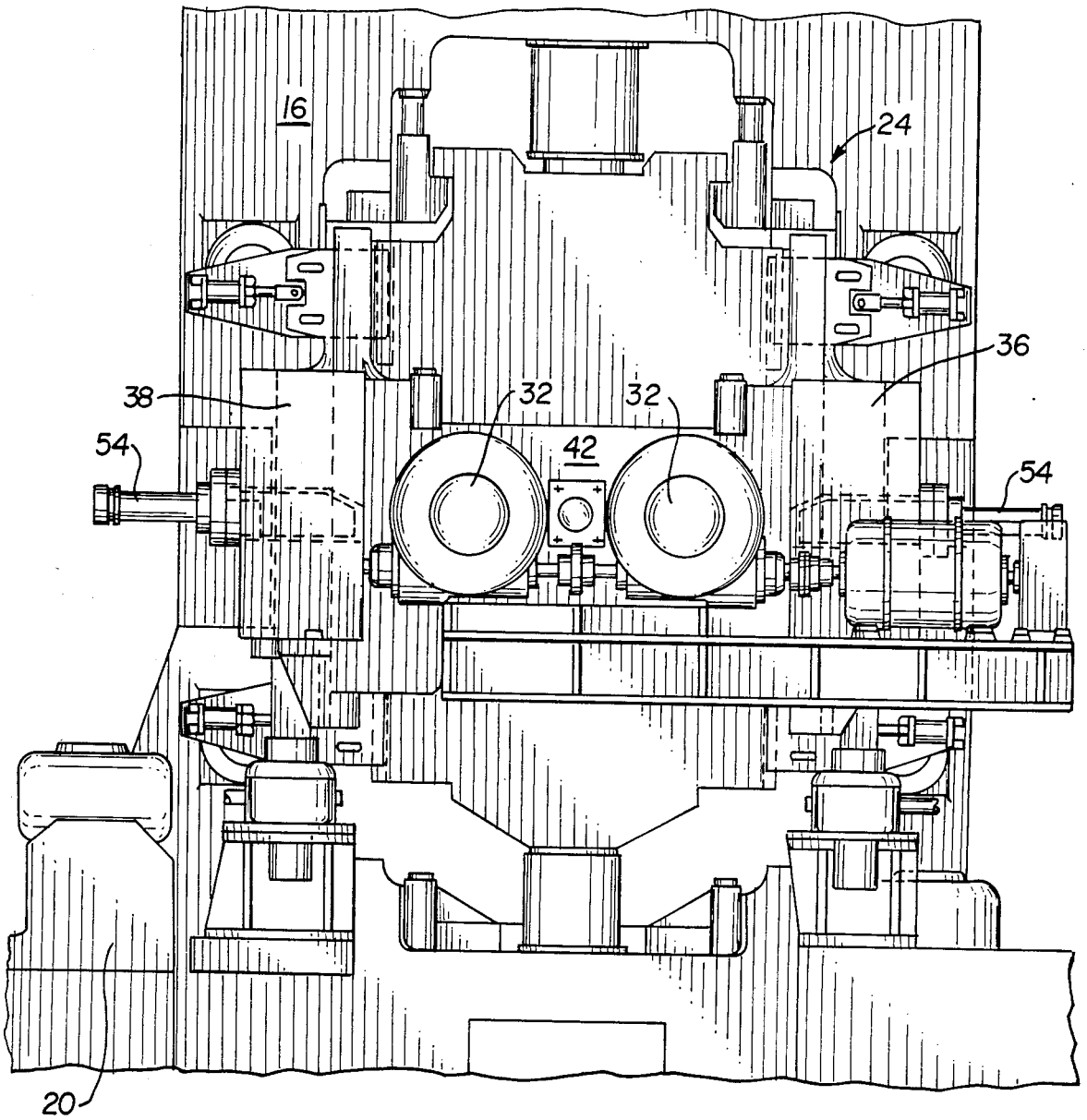
FIG. 5 is a side elevational view taken along lines 5—5 of FIG. 3 showing a pin mechanism for retaining the removable yoke in the frame.

Electrically operated adjusting screws are provided for both the horizontal and vertical rolls when in mill 10. Those adjusting screws for the vertical rolls are best shown in FIGS. 4 and 5 at 32, and those adjusting screws for the upper and lower horizontal rolls are shown best at 34 in FIGS. 1, 2, and 6. These screws 32 and 34 for the vertical and horizontal rolls act against the chocks of their respective rolls in a conventional manner to obtain and maintain the rolls in their proper operating positions.

The above details for a universal beam mill are well-known in the industry, and therefore are not in themselves part of the novel concept of the present invention. Additional background and the principles and operation for rolling shaped sections can be found in the aforesaid U.S. Pat. Nos. 3,559,440 and 3,968,672; as well as in U.S. Pat. Nos. 3,212,314; 3,425,255; and 3,802,242.

A novel feature for the present invention lies in the construction for an inner mill frame 24 shown in detail throughout FIGS. 1 through 7. Reversed to FIG. 1, with regard to FIGS. 3, 4, 6 and 7, the left hand side is referred to as the operating side and the right hand side is the drive side for the mill 10.

Referring particularly to FIG. 4, internal frame 24 consists of two spaced-apart horizontally disposed cross members 36, 38 positioned in the windows of vertical housings 16 and 18. These cross members 36 and 38 are joined at their end at the drive side by a yoke member 40, and at the operating side by a removable yoke member 42. Both yoke members 40 and 42 substantially extend the height of cross members 36 and 38, and as FIG. 4 particularly shows are keyed into cross members 36 and 38. Even though not shown, yoke member 40 is permanently bolted in place.

Still referring to FIG. 4 screw jacks 32 for vertical roll 44 are carried by and extend through yoke member 40 for engagement with the chock of roll 44. Similarly, screw jacks 32 for vertical roll 46 to the left of FIG. 4 are carried and mounted in yoke members 40 and 42 for engagement with the chock of roll 46. In FIG. 4, a lower portion shows vertical rolls 44, 46 in their minimum operating position and an upper portion shows them in their maximum operating position. As is customary, jacks 32 for vertical rolls 44, 46 are driven through a worm gear set and electrical drive motor assembly 48. A balance system of the vertical rolls 44, 46 is done through an hydraulic mechanism 50 located between screw jacks 32 for each roll 44, 46.

Both chocks for vertical rolls 44, 46 are supported for movement in cross members, 36, 38 through guide rails 52 in cross members, 36, 38 located on either side of the chocks. These guide rails 52 are best shown on cross member 36 in FIG. 6 and even though not shown are provided on cross member 38.

Figure 3:
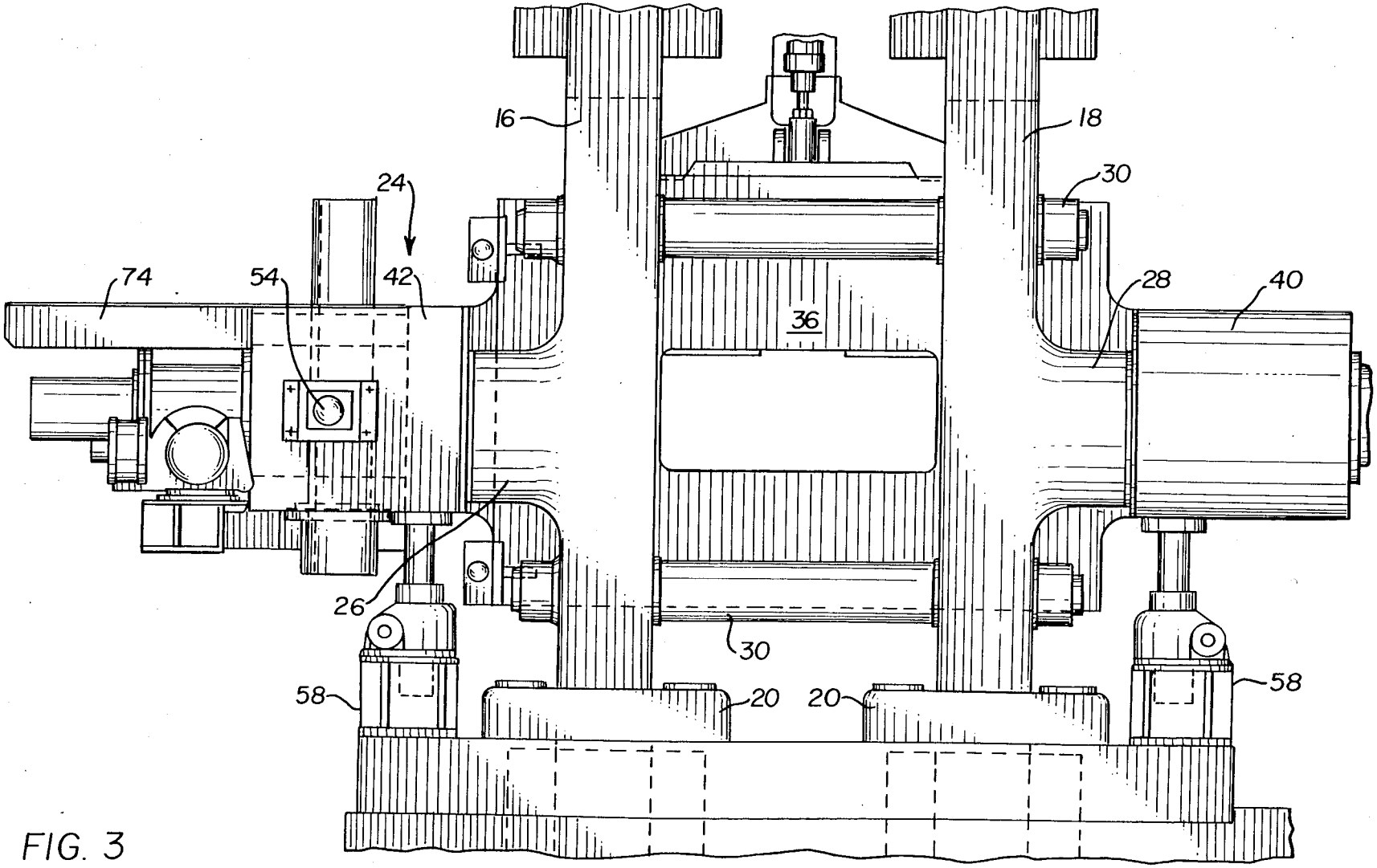
FIG. 3 is a front elevational view with a roll set removed from the mill for clarity.
Figure 6:
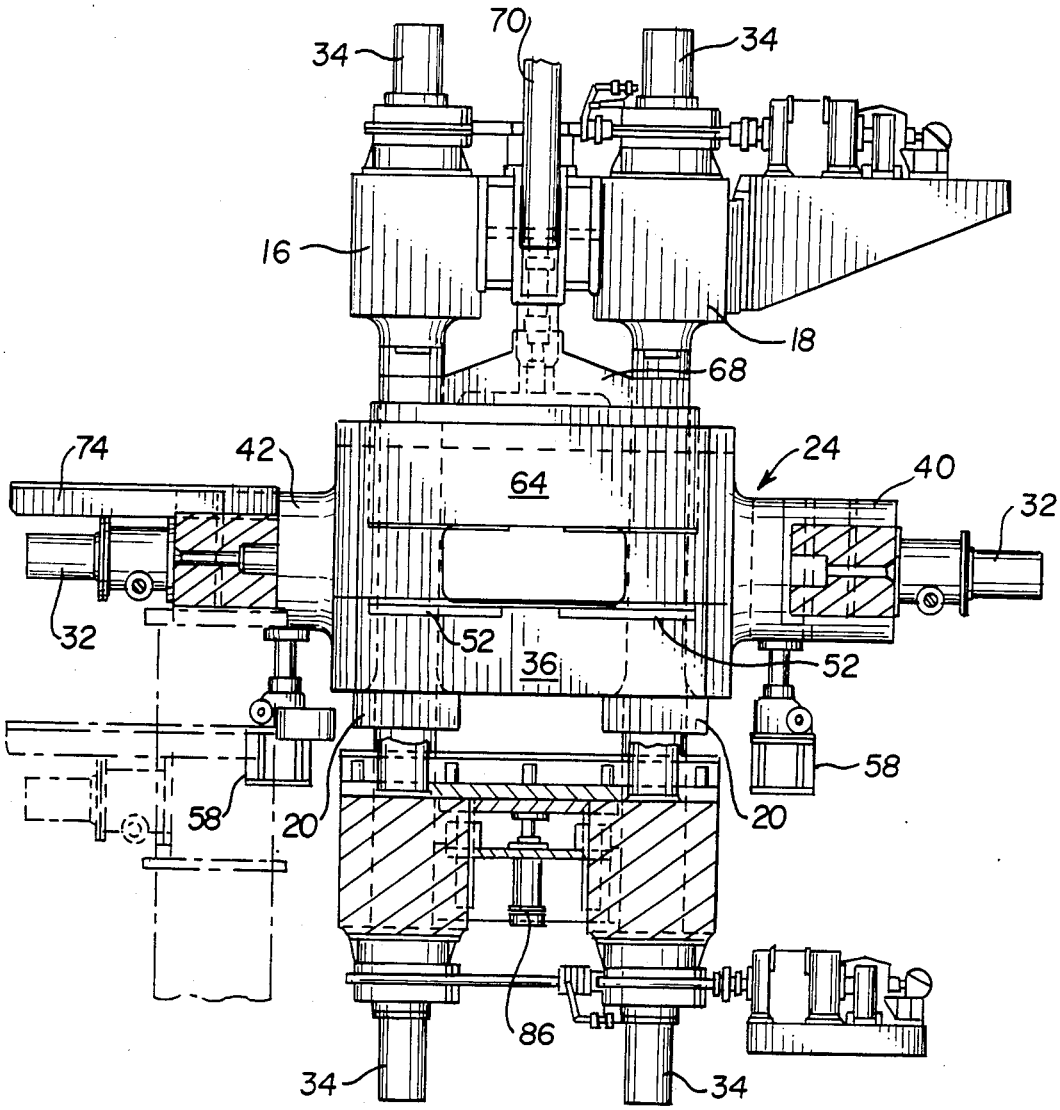
FIG. 6 is a front elevational view partly in cross sectional, but on a smaller scale than that of the other FIGURES, and illustrating a lifting unit in the stand for removal of the roll set which is not shown for clarity.

Still referring to FIG. 4 and best shown in FIGS. 3 and 6, removable yoke member 42 is keyed into and retained in a traverse direction in cross members 36, 38 through hydraulically operated pins 54 extending through the cross members 36, 38 and into removable yoke member 42. These pins 54 are located outside of vertical housing 16, as best shown in FIG. 4. Retention of removable yoke member 43 in a longitudinal direction in cross members 36, 38 is done via hydraulic means 56 mounted in removable yoke member 42 and acting on cross members 36, 38 as shown in FIG. 4.

As FIG. 1 shows, cross members 36 and 38 are located in and extend through the window of vertical housings 16, 18. Outside of vertical housings 16, 18 cross members 36, 38 are keyed into the horizontal wings 26, 28 of vertical housings 16, 18 which keyed portions slide along liners in the horizontal keyed portions.

The wings 26, 28 of housings 16, 18 in FIG. 1 add the desired strength to the vertical roll assemblies of the roll set. The housings of FIG. 4 do not have wings. Instead, the inner frame 24, i.e., cross members 36, 38 are made to be thicker than those in FIG. 1 in order to give the desired strength to the vertical roll assemblies.

Vertical movement of internal frame 24 and its support in mill 10 is done via hydraulic jacks 58 shown in outline form in FIG. 4 and more defined in FIGS. 3 and 6, which jacks 58 abut against the undersurface of an outer portion of cross members 36, 38 fitted into the horizontal wings 26, 28 of vertical housings 16, 18.

Figure 2:
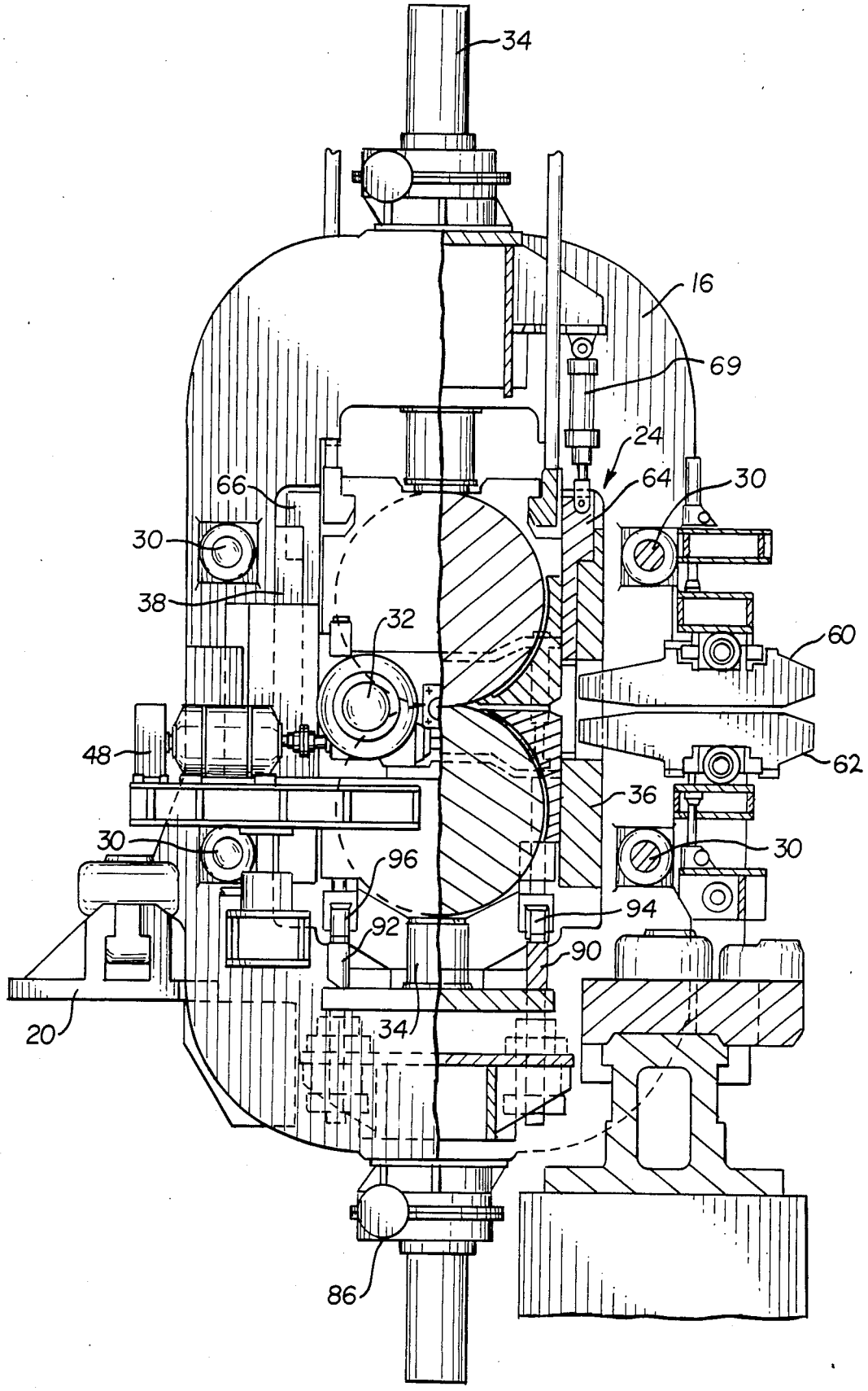
FIG. 2 is a side elevational view partly in section of the mill shown in FIG. 1.
Figure 7:
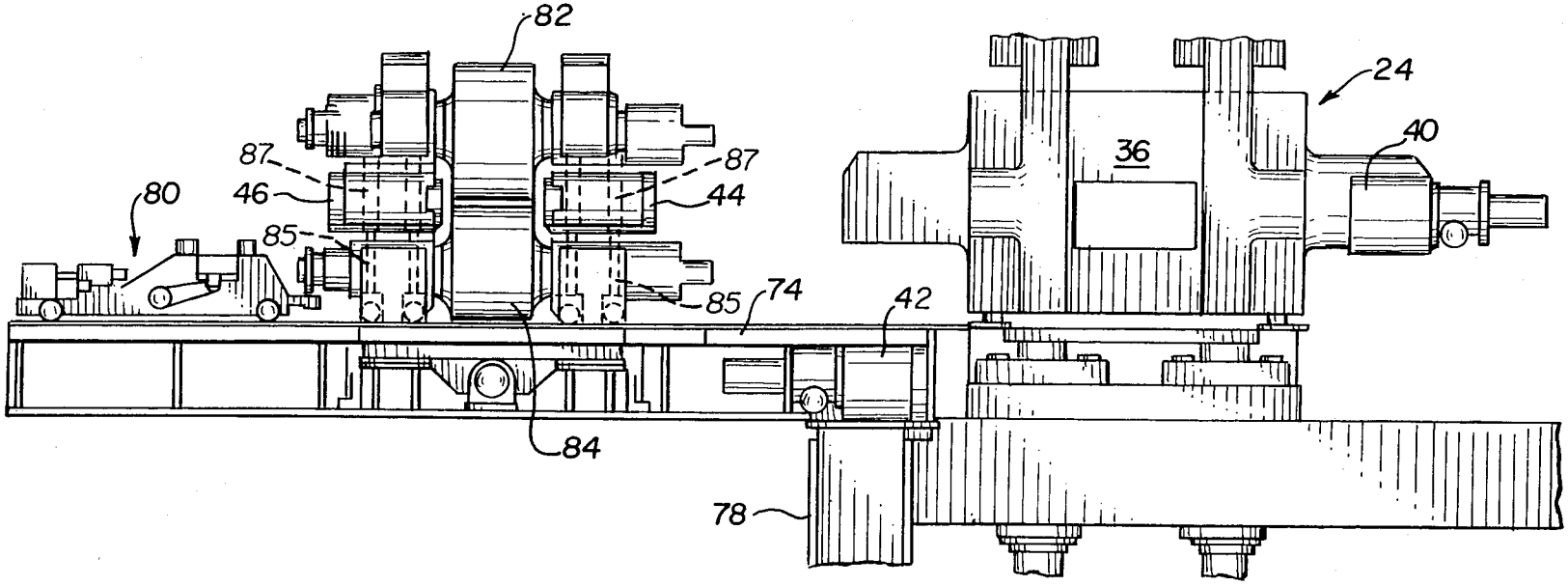
FIG. 7 is a front elevational view being the same scale as FIG. 6 illustrating removal of the frame of the present invention out of the mill and the roll set out of the frame.

A better defined configuration for internal frame 24 in mill 10 is shown in FIGS. 3, 6, and 7 with less details for mill 10 for clarity. As shown in these FIGURES, cross members 36 and 38 each has a window through which the stock travels through the rolls in its shaping process from which stock upon its exit from mill 10 is guided through top and bottom guides 60 and 62, respectively as shown in FIG. 2, and which bottom guide 60 at least can be considered conventional in the industry. The window or opening in cross members 36 and 38 correspond to each other and their horizontal dimension is such as to accommodate the range of products and number of passes required to roll the product a desired shape and size.

Further retention of internal frame 24 in mill 10 is achieved through clamping plates 64, 66 each located on opposite sides of the window in vertical housings 16, 18 (FIG. 2).

Each clamping plate 64, 66 extends between the vertical housings 16 and 18, and engages its cooperative cross member in a stepped fashion and is wedged between its cooperating cross member and the chock of the upper horizontal roll in a manner best shown in FIG. 2. As seen in FIG. 6, the clamping plate 64 has a center bracket portion 68 attached to an hydraulic piston cylinder assembly 69 to which as shown in FIG. 1 is attached to a horizontal member 72 extending between the vertical housings 16, 18.

The clamping plate 66 on the opposite side of mill 10 in FIG. 2 is mounted and interconnected to its respective cross member similarly to that of clamping plate 64 including its being connected to a piston cylinder assembly mounted in the same fashion as described above for clamping plate 64. For passline vertical adjustment to move inner frame 24, piston cylinder assembly 69 is operated to free the clamping plates 64, 66 from inner frame 24 so that inner frame 24 can be moved vertically by piston cylinder assemblies 58.

Pass line adjustment of inner frame 24 is done through the simultaneous operation of screw jacks 58 at the bottom of cross members 36 and the movement of clamping plates 64, 66 in a vertical direction. This vertical movement of internal frame 24 moves only the vertical rolls 44, 46 and does not disturb the positioning of the horizontal rolls. Positioning of the vertical rolls 44, 46 for any change in beam size can be made through the present invention which permits a correct center web rolling for the beam.

The arrangement and construction of the internal frame 24 of the present invention provides a completely enclosed horizontally disposed housing guided within the vertical housings 16 and 18 of mill 10. The separating force acting on the vertical rolls is absorbed by the internal frame 24, and in the usual fashion, the separating force of the horizontal rolls is absorbed by the vertical housings 16 and 18. The arrangement of internal frame 24 in mill 10 also gives the desired rigidity to the mill which is extremely important in rolling a beam whereby the rolling and separating forces constantly occur in several different directions.

Due to the construction of internal frame 24 and its interconnection with the vertical housings 16, 18 the internal frame 24 is permanently retained in mill 10, and remains there during the roll set changing operation with only the removable yoke member 42 being removed from the inner frame out of its rolling position of FIGS. 3 and 6. The non-rolling and roll set changing position of removable yoke member 42 is shown specifically in FIG. 7. At the top of removable yoke member 42 is a set of rails 74, 76 (FIG. 1) and located below the removable yoke member 42 is a lift unit 78 as seen in FIGS. 1 and 7. In the roll set changing operation, the pins 54 and hydraulic mechanisms 56 in removable yoke member 42 are deactivated to disengage it from the cross members 36 and 38, and member 42 is lowered by lift unit 78 until rails 74 and 76 on removable yoke member 42 are aligned with the rails provided both in and out of the mill 10 constituting a rail system which is conventional in the industry for roll set changing.

Removal of the roll set is done by a carriage 80, which roll set having vertical rolls 44, 46 and horizontal rolls 82, 84 is extracted from internal frame 24, which frame 24 is shown to be out of the mill 10 for clarity as shown in FIG. 7. From this rail system of FIG. 7 the roll set is transferred onto a side shifting unit 14 of FIG. 1. A new roll set 86 (FIG. 1) is inserted into the internal frame 24, and the removable yoke member 42 on the operating side of mill 10 is raised by lift unit 78 back into its operating position, wherein the pins 54 and hydraulic mechanisms 56 engage the cross members 36 and 38 for retention of the removable yoke in internal frame 24. The pass line via jacks 58 abutting cross members 36, 38, in mill 10 is set according to the size of beam for the rolling operation.

Since the internal frame 24 remains in the mill 10 and only the roll set is removed, a stooling pin arrangement is provided in the horizontal and vertical roll chocks, which stooling arrangement is shown in FIG. 2 with the roll set in mill 10, and best shown in FIG. 7, where the roll set is removed from internal frame 24. As can be seen, the chocks of the lower horizontal roll has stooling pins 85 located on both sides of the chocks. The vertical roll chocks contain a stooling pin 87 which extends up into the horizontal chock of roll 82.

Activation of the stooling pins 85 triggers the stooling pins 87 of the vertical roll chocks to move up into the upper horizontal roll chocks. This activation of the stooling pins 85 of the lower horizontal roll chocks is brought about by a lifting unit 86 shown in FIGS. 2 and 6. This lifting unit 86 is equipped with rails 90, 92 which extend between vertical housings 16, 18.

In roll set changing, lifting unit 86 engages wheels 94, 96 (FIG. 2) on the chocks of lower horizontal roll 84.

In the final up-stroke travel of lifting unit 86, the stooling pins 85 in the lower horizontal roll chocks will become activated, which then sets the remaining stooling pins in the vertical chocks in motion, forming a complete interlocking supporting system for the roll set in mill 10 for its removal therefrom as explained above.

While considerable emphasis has been placed herein on the preferred embodiment disclosed and described, it will be appreciated that many embodiments of the invention can be made and many changes can be made in the preferred embodiment without departing from the scope and spirit of the present invention. For instance, instead of jacks 58 for internal frame 24, hydraulic cylinders equipped with position regulators for fast and correct pass line adjustment can be used or a wedge arrangement can be used.

It is to be noted that a roll set with only vertical or horizontal rolls may be inserted into the mill 10 while the horizontal inner mill frame 24 remains therein. Also, it is to be emphasized that when the roll set shown herein is removed from mill 10, that inner frame 24 remains in its position shown in the FIGURES.

In accordance with the patent statutes, we have explained the operation and principles of our invention, and have described and illustrated what we consider to be the best embodiment thereof.

We claim:

1. A universal rolling mill for rolling shaped sections, such as beams, rails, by a roll set and having a drive side and an operating side, comprising:

at least an upright vertical housing having a window;

a generally horizontal frame supported in and having portions extending outwardly from said window of said housing;

said roll set positioned in said frame and consisting of a pair of cooperative vertical roll assemblies and a pair of cooperative horizontal roll assemblies cooperating with each other and having their axes arranged in a generally common vertical plane;

said vertical roll assemblies being supported at least in part by said frame portions;

means for adjusting the elevational height of said frame and said vertical roll assemblies; and one of said frame portions located on said operating side taking the form of a removable member, including means for securing and detaching said removable member to and from said frame for easy removal and insertion of said roll set to and from the mill.

2. A universal rolling mill according to claim 1, wherein said frame further comprises two spaced-apart cross members arranged to extend on the drive and operating side of the mill and having openings through which said section travels and having surfaces arranged in sliding contact with said vertical housing and guidable therealong; and a fixed member secured to the ends of said cross members on said drive side opposite to said removable member, said fixed and removable members each carrying a different one of said vertical roll assemblies.

3. A universal rolling mill according to claim 1, further comprising: clamping plate means suspended from the top of said vertical housing and having portions which wedge between said cross members and at least said vertical roll assemblies for retaining said frame in said mill and means for positioning said clamping plate means against said cross members and including means for allowing said clamping plate means to move with said cross members upon operation of said adjusting means for said frame and vertical roll assemblies.

4. A universal rolling mill, according to claim 1, including a rail system for replacement of said roll set, wherein said removable member consists of a set of rails on its upper section and is located outside said mill, and said mill further comprises means for raising and lowering said removable member in a vertical direction relative to said mill wherein in its lower most positioning said set of rails becomes a part of said rail system for said changing of said roll set.

5. A universal rolling mill according to claim 1, wherein said adjusting means consists of a plurality of adjusting devices located outside of said mill and engaging said frame at several points.

6. A universal rolling mill according to claim 1, further comprising a stooling arrangment in said horizontal roll assemblies and in said vertical roll assemblies, and lifting means located in said mill beneath said horizontal and vertical roll assemblies for supporting said roll set during said changing of said roll set, said stooling arrangement including means for triggering each successsive stooling arrangement in cooperation in a manner said horizontal and vertical roll assemblies form an interlocking supporting system for said roll set for its replacement in said mill.

7. A universal rolling mill according to claim 1, wherein said vertical housing consists of outwardly extending wings cooperating with said frame portions for giving the desired strength to said frame and said vertical roll assemblies.

* * * * *